US006233904B1

(12) United States Patent
Kovacs et al.

(10) Patent No.: US 6,233,904 B1
(45) Date of Patent: May 22, 2001

(54) APPARATUS FOR THE SIMULATANEOUS TRANSPORTATION OF A GROUP OF FIBER BAND CANS

(75) Inventors: Otmar Kovacs, Dietfurt; Michael Ueding, Ingolstadt, both of (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/562,483

(22) Filed: May 1, 2000

Related U.S. Application Data

(62) Division of application No. 09/073,231, filed on May 5, 1998, now Pat. No. 6,055,792.

(30) Foreign Application Priority Data

May 10, 1997 (DE) ..... 197 19 765

(51) Int. Cl.[7] ..... B65B 63/04; D04H 11/00

(52) U.S. Cl. ..... 53/249; 53/430; 53/473; 19/159 R

(58) Field of Search ..... 53/473, 430, 118, 53/237, 249, 284.5; 19/159 R, 157

(56) References Cited

U.S. PATENT DOCUMENTS

| | | | |
|---|---|---|---|
| 4,688,300 | 8/1987 | Langen et al. | 19/159 A |
| 5,226,212 | 7/1993 | Beringer | 19/65 A |
| 5,447,007 | 9/1995 | Reil et al. | 53/133.2 |
| 5,471,711 | 12/1995 | Koyacs et al. | 19/159 A |
| 5,595,049 | 1/1997 | Leifeld | 53/430 |
| 5,634,316 | 6/1997 | Leifeld | 53/118 |
| 5,664,398 | 9/1997 | Leifeld | 53/118 |
| 5,729,868 | 3/1998 | Liedgens et al. | 19/159 R |

FOREIGN PATENT DOCUMENTS

| | | |
|---|---|---|
| 3734258 A1 | 4/1989 | (DE) . |
| 4231698 A1 | 3/1993 | (DE) . |
| 4435853 A1 | 4/1996 | (DE) . |
| 0508365 A1 | 10/1992 | (EP) . |

OTHER PUBLICATIONS

German Patent Office Search Report, Sep. 4, 1997.
European Patent Office Search Report, Mar. 3, 1999.

*Primary Examiner*—Peter Vo
*Assistant Examiner*—John Paradiso
(74) *Attorney, Agent, or Firm*—Dority & Manning

(57) ABSTRACT

The present invention concerns a procedure and an apparatus for the simultaneous transportation of one group of cans (31, 310, 311) in a row from a can rack (6, 60, 61)—the cans (3) being capable of being filled with fiber band—to a frame machine (2) and/or to another textile machine (4) or to a can depot (5). The group of cans (31, 310, 311) is brought in common with the can rack (6, 60, 61) for the filling of said cans (3) into a first work station ($A_1$) on the frame machine (2). The can rack (6, 60, 61) remains at that point during the filling of the cans (3) of this can group (31, 310, 311) until, after the filling of all the cans (3) on the can rack, the can rack (6, 60, 61) then, once again with the cans, is transported to the additional textile machine (4) or to the can depot 5. The can rack (6, 60, 61) may, together with the can group (31, 310, 311), be brought to another work site at, for instance, the additional textile machine (4) or to a storage zone in a can depot (5), to remain there during the processing of the fiber bands which are in the cans (3) of this can group (31, 310, 311) or during the storage of said can group.

8 Claims, 4 Drawing Sheets

APPARATUS FOR THE SIMULATANEOUS TRANSPORTATION OF A GROUP OF FIBER BAND CANS

This application is a Divisional Application of U.S. application Ser. No. 09/073,231, filed May 5, 1998 now U.S. Pat. No. 6,055,792.

BACKGROUND OF THE INVENTION

The present invention concerns a procedure for the simultaneous transportation of cans capable of being filled with fiber band which are arranged in a row on a can rack and form one can group, and which are transported between a frame machine and/or a further textile machine or to a can depot, as well as an apparatus for the execution of this procedure.

In common knowledge, through DE 42 33 357 A1, is the use a transport vehicle to move several cans arranged in a row as a group and to bring said group to a wagon regularly available at a frame machine. At this point, the group of cans is transferred from the transport vehicle to said machine wagon. Cans are then exchanged, one for the other, between the wagon of the frame machine and the transport vehicle. For this purpose, it is necessary to allow one empty place on the transport vehicle for one can. Further, it is necessary to inch step-wise along the wagon of the frame machine, so that a full can from the wagon will be switched onto the transport vehicle, and an empty can switched from the transport vehicle to the wagon. For this operation, a complicated drive and control mechanism is required.

OBJECTS AND SUMMARY OF THE INVENTION

The purpose of the present invention is to create a procedure and a corresponding apparatus which simplifies the can transport to and from the work station of the frame machine. Additional objects and advantages of the invention will be set forth in part in the following description, or may be obvious from the description, or may be learned through practice of the invention.

According to the invention, since a complete can group is exchanged each time, no apparatus is required to carry out complicated maneuvering and positioning at the frame machine, as this is necessarily carried out when one can after another must be exchanged between the transport vehicle and the frame machine. Because of this, the expenditure for the design, manufacture, material and time in comparison to the conventional methods and equipment is reduced.

In order that as little time as possible will be required for the exchange of the can rack at the frame machine, the procedure of the invention is enhanced in that the can rack with the can group is brought to a first holding station, from there moved to a filling operation in the first work station, and following that, to a second holding station. By the method there shown, the placement and pick-up of a can rack is, time-wise, independent of the filling of the cans.

By means of an advantageous design of the procedure of the invention wherein the filling at the frame machine is monitored, and dependent upon the progress of the filling of the cans of the can group in place on the frame machine, a signal is given for the exchange of the can rack with the full cans of this can group for another can rack with empty cans of another can group, assurance can be given that a can rack with empty cans will always be delivered to the frame machine at the right time and conversely, a can rack with full cans may be picked up.

It is practical if the can rack, which was exchanged on the frame machine for another can rack, and with unchanged accessories, now finds additional applications, whether this be for immediate processing of the fiber band in the cans of this can group, or for intermediate storage in a can depot which storage allows for feeding at a given time the fiber bands to a textile machine for processing. In this way, waiting times are shortened, which leads to an improved efficiency of the band processing textile machine.

The fiber band processing machines, i.e. flyer or open end spinning machines, exhibit a multitude of similar work stations. In order to put the procedure of the invention to use in an optimal fashion, it is advantageous, if the can rack, the work station of the textile machine and/or the storage placement of the can depot are uniform in regard to their dimensioning wherein the number of the cans belonging to a can group is so determined that at any time a group can rack finds place for a multiple integer thereof in the work station and/or in the depot.

If several can racks find a placement beside one another at a textile machine or in a can depot, the danger arises that by manipulating one can rack, the neighboring can rack will be pushed away. Under certain conditions, this can lead to disturbances of production. To avoid this undesirable shoving of can racks, the procedure in accord with the invention has been advantageously improved wherein the can rack is securely fixed in its work station and/or the depot and/or its transport medium.

As has been mentioned, a shortening of the waiting time at the frame machine has been found by monitoring the procedure of filling.

In similar manner, it is advantageous if a fiber band processing machine is provided with a monitoring system wherein the run-out or breakage of one or more of these fiber bands is recorded and a subsequent triggering of a function is caused by a number of such recordings, i.e. the triggering of an acoustic or an optical signal or even an exchange of the can rack.

For the carrying out of the procedure, an apparatus is provided for the simultaneous transportation of a group of cans capable of being filled with fiber bands, said transportation being between a slide conveyor located on a frame machine and a further textile machine or a can depot, the latter possessing a can rack for the acceptance of a can group arranged in row units. The can rack brought to the frame machine still remains there during the filling of the cans in the can group already on the can rack on the frame machine, and said group only leaves the frame machine after the complete filling-of the cans in common with their can group. Therefore, there is only required an essentially simple motion and control based operation for the exchange of these cans between the transport vehicle (can wagon) and the machine. This reduces the costs for the design, manufacture and the material for the previously required elements as well as saving time for the course of the processing Through a practical improvement of the invention wherein a monitoring device is assigned to the frame machine for the supervision of the progress of the filling of the cans of the can group, the monitoring device in communication with a control device triggers, in dependency with the progress of the filling of the cans, a signal for the exchange of the can rack having the full cans of this can group exchanged for another can rack with empty cans of another can group, the waiting time can be shortened by a time centered coordination of the filling of the cans with the can exchange. By the term "can exchange" is understood the bringing of a can rack with empty cans to the frame machine, and the removal of a can rack with full cans therefrom, even when the bringing and removal of a can rack is done, time-wise, independently of one another.

In order to avoid a loading and unloading of the can rack on the fiber band processing textile machines and possibly at the provided can depot for the intermediate storage of the cans with attendant loss of time, it is advantageous if the invented apparatus is improved in that the can rack together with the can group is capable of being brought into an-additional work station which is assigned to the further textile machine or into a storage location in a can depot, and further to remain there during the processing of the fiber bands to be found in the cans of this can group, or during the storage of this can group.

For the optimal storage of can racks at, for instance, a textile machine or in a can depot, the said textile machine on the one hand and the can depot on the other are dimensionally coordinated with one another so that a multiple integer of can racks may simultaneously be placed beside one another at this textile machine or at a section thereof, for instance in a can depot.

If the slide conveyor of the frame machine is designed with an endless belt or an endless chain, upon which, for instance, at least two can racks can be placed, one behind the other, and which are to be found in the first work station of the frame machine, then the exchange of can racks can be carried out, even when cans of a can group on a can rack are not entirely filled again with fiber band. While the one can group is filled, another can rack with filled cans may be removed and a can rack with empty cans be set by ready for use.

The can rack can be designed in various ways. A particularly simple and thus low cost can rack results from the design as a pallet, and possibly in that the palettes which form the can racks show normal outside dimensions, to which the further textile machine or a section thereof, or the can depot is made to fit. Further practical designs of the can rack are described herein.

Principally, the can rack can be manually or automatically transported. In the case of automatic transport, the can rack is, in practice, transported by a can wagon which will accept the can rack to accomplish the transport to the frame machine, to a further textile machine or to a can depot, or, after the transport, will withdraw said can rack, and possibly in that the can wagon is provided with a control device, by means of which the transport path and the transport point of time can be specified.

Advantageously, a can rack receiving means is provided among the individual components of the factory setup. As to what the individual "components" are, consider a frame machine as a fiber band delivery machine, a "further textile machine" a fiber band consuming machine, to these add a can depot, and all always in the singular or plural.

In order to stabilize the can rack in its position on a textile machine, in a can depot and/or on a can wagon, a securement device for the can rack is provided, with the aid of which the undercarriage can be put out of action.

In order to exchange the can rack at the fiber band processing textile machine without unavoidable loss in time, if the fiber band in one or more of the cans in the can group on the can rack is run out or broken, a monitoring and control system can be put to use which alarms upon the running out or breaking of at least one of the fiber bands of this can group and which may possess an adjustment means, by means of which, for the triggering of an exchange function, a value is determinable for the number of cans in which the fiber band ran out or broke in the can group on the can rack.

Both the procedure as well as the apparatus of the invention, are simple and also can be applied retroactively to already existing machines or equipment.

In accord with the invention, the cans of a can group, not only during the transport, but also for filling, are kept together as a can group at the frame machine and after filling, they are picked up again as a complete can group. Thus, the control and time expenditures for a can exchange are reduced. This expense is looked upon, in the concept of the invention, as a component of the can transport.

If this can exchange is carried out automatically, then the apparatus, in comparison to conventionally known automatic apparatuses up to this time, can be constructed more simply and hence also more economically built and manufactured.

The invention is more clearly explained by drawings and in the following embodiment examples.

DETAILED DESCRIPTION

Figure 1:
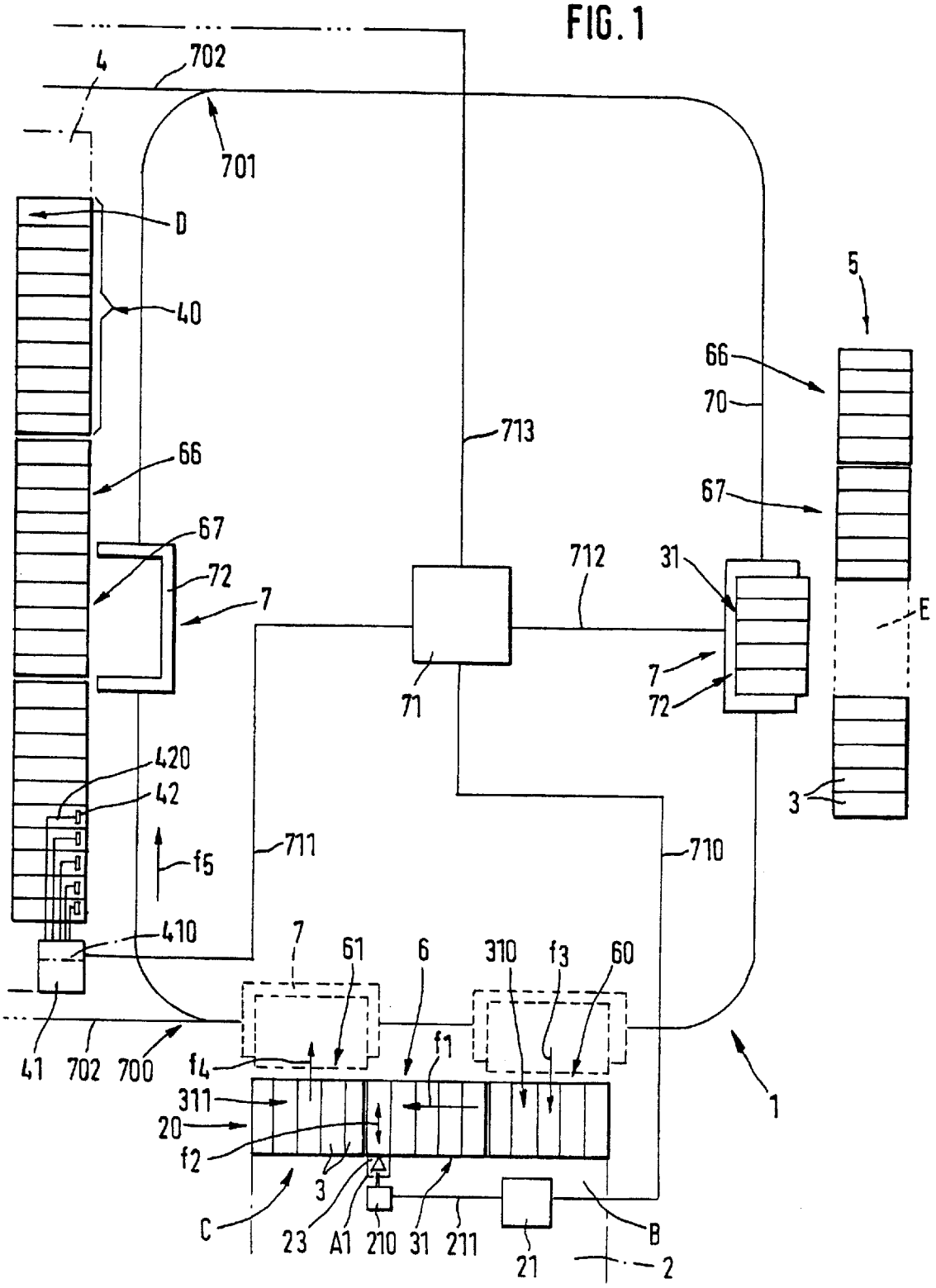
FIG. 1 is a schematic presentation of a factory layout in accord with the invention having a frame machine, a band processing textile machine and a can depot as well as several can racks for transporting can groups as complete units within this layout.

Reference will now be made in detail to one or more presently preferred embodiments of the invention, one or more examples of which are shown in the drawings. Each example is provided by way of explanation of the invention, and not as a limitation of the invention. For example, features illustrated or described as part of one embodiment, may be used with another to yield still a third embodiment.

The essence of the invention is first made clear with the aid of FIG. 1, which shows schematically a factory layout 1 with a multiplicity of individual components, such as a stretch frame machine 2, a fiber band processing textile machine 4, and a can depot 5.

Figure 4:
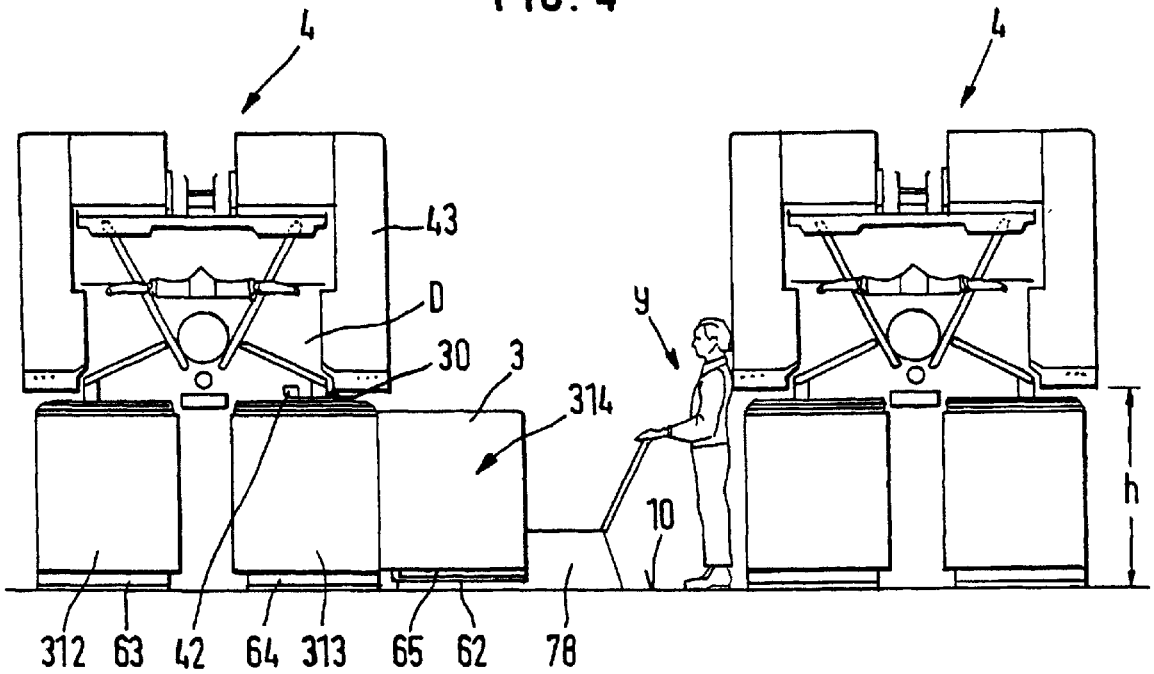
FIG. 4 is two open end spinning machines in cross section with can racks designed as pallets, of which can racks, one is brought by means of a fork truck by an operator into its processing position under a spinning machine.
Figure 5:
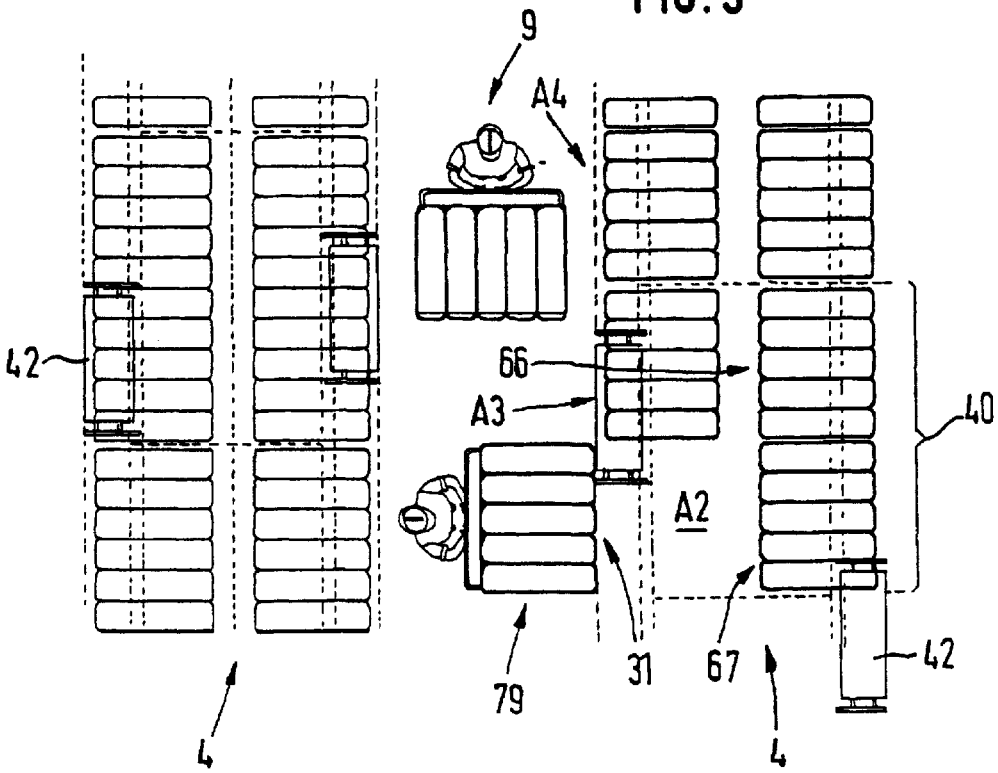
FIG. 5 is a plan view of partial areas of two open end spinning machines, at which, one operator withdraws a can rack, designed as a pallet, carrying empty cans from its working position under the machine, while a second operator, with the aid of a can wagon, approaches with a can rack with filled cans.

The previously named components, upon need, may be provided singly or multiply within the area of the said layout 1, as, for example, is evident from the FIGS. 4 and 5 (in this refer to the two band processing textile machines 4). Furthermore, the selected components are not to be described in words of narrow semantics, but are to be understood as synonyms for a specific kind of a machine, or equipment part. So, in this thought, the foregoing concept "stretch frame machine 2" stands for one or more fiber band supply or fiber band producing machine(s) at which cans 3 are filled with fiber bands.

The cans 3 possess, in accord with the pictured embodiments, an essentially rectangular shape. The present invention may also find application with cylindrical cans (not shown).

In fiber band processing textile machines 4, various kinds of spinning machines find use. Among these will be ring spinning or open end spinning machines, but also flyer or knitting and weaving machines, which are dedicated to the production of lapped knit goods or woven fiber bands 30. In the case of the following description, essentially, an open end spinning machine will be chosen as the embodiment.

Also the special design of the can depot 5 is principally irrelevant to the present invention. Hence a receiving dock E (FIG. 1) will suffice for illustrative purposes.

The filled cans 3 in frame machine 2 are arranged on a can rack 6 as group 31 and under that designation said cans 3 are transported as a group unit back and forth between the individual components of the factory layout 1. In accord with the illustrated embodiment example in FIG. 1, a plurality of can wagons 7 are provided, from which each is able to accept a can group 31 as a unit load and bring it from the frame machine 2 (which is fiber band supplying or fiber band producing) for further fiber band processing or consuming at textile machine 4 or for intermediate storage at the can depot 5.

Further, in the embodiment shown in FIG. 1, the can wagon 7 is designed as automated. The drive mechanisms for this are not shown in drawings on the grounds of clarity in illustration. The automated can wagon 7 is movable on a track 70 between the individual components of the factory layout 1. The concept "track" is not to be understood in a narrow interpretation of the word, but should encompass also infrared or ultra-sonic guidance as well.

If the can wagon 7 is manually driven, then "track" falls also within this milieu, i.e. a concept of "way", along which the can wagon 7 is—or may be—transported.

After the factory layout 1 has been described in general terms, now its finer components should come under a more detailed inspection.

Next, with the aid of a can wagon 7, a can rack 6 loaded with empty cans 3 is brought to a frame machine 2, which machine, in the customary way, is equipped with one or more filled charging heads 23. The frame machine 2 possesses a slide conveyor 20, to which the can rack 6 with the complete can group 31 is then transferred. Subsequently, with the help of the slide conveyor 20, this unit can group 31 carrying empty cans 3, in common with the can rack 6 which accepts it, is brought for the filling of said cans 3 to a first work station $A_1$—further work stations are present on other components of the factory layout 1 and will be described later.

The area designated as work station $A_1$ at the frame machine 2 is to be understood as that area in which any cans 3 of a can rack 6 are found in the discharge zone of the charging head 23, with the help of which charging head 23, the cans 3 are filled in the usual manner with fiber band 30 (see FIG. 4).

In this first work station $A_1$, the cans 3 found on the can rack 6 pass the charging head 23, one after the other in the direction of the arrow $f_1$. The can 3 to be filled is, in this procedure, removed from can rack 6 for a short period by a gripping device (not shown). It is moved in the direction of the double arrow $f_2$ of the frame machine 2. Next the can 3 is lifted up under the charging head 23 and subsequently, after the can has been filled, replaced by the non-illustrated gripping device onto the can rack 6 in the proper position within the can group 31. After the just filled can 3 is replaced again in its exit position on the can rack 6, it is moved again stepwise, that is, the breadth of a can in the direction of the arrow $f_1$ so that the next empty can 3 comes into the work station $A_1$, in which said can 3, by means of the gripping device of the frame machine 2 is once again brought under the charging head 23. During the entire period, while any can 3 of the can group 31 belonging to the can rack 6 is being filled, the can rack 6 remains with the remainder of the cans 3 in this first work station $A_1$ at the frame machine 2.

If the cans 3, collectively, of this can group 31 are filled, then the can rack 6, now together with the complete can group 31 is transferred to the can wagon 7 and with the help of this, is shuttled either to direct processing of the fiber bands 30 on a fiber band processing textile machine 4 or, if at that moment all of the fiber band processing textile band machines 4 are already supplied with fiber bands 30, then said can rack 6 is sent to one of the can depots 5 for an intermediate holding pattern.

In accord with the illustrated embodiment in FIG. 1, the slide conveyor 20 possesses a length which is greater than one of the can groups 31—the cans of which are in the process of being filled—is able to occupy. Much more, in the said slide conveyor 20 (arrow $f_1$) before the work station $A_1$, a primary waiting station B is envisaged. In this waiting station B, into which a second can group 310 on a can rack 60 has already been transferred in the direction of the arrow $f_3$, even though at that time, not all of the six assigned cans 3 of the first can rack 6 have been filled. In the direction of the slide conveyor (see arrow $f_1$) behind the work station $A_1$, a second holding area C is provided in which a can rack 61 with an already filled can group 311 is temporarily stored, so that, at a chosen time, it can be moved in direction of the arrow $f_4$ onto a can wagon 7 and with the aid of the can wagon 7, taken away.

After the filling of its can 3, the can rack 6 moves out of the work station $A_1$ into the second waiting station C which, as noted above, has now become free, from which in turn, at a convenient time, it will be picked up by the can wagon 7. At the same time, along with this stepwise sliding of the first can rack 6 into the holding area C, now the second can rack 60, which is already in direct proximity to the first can rack 6, likewise moves out of its waiting station B into the work station $A_1$.

It is obvious that the total length of the slide conveyor 20 is not only the size that essentially three can racks 6, 60, 61 can find place next to one another. In order to be able to compensate for waiting periods which arise through the passing by of the can wagon 7, during its emptying and/or connection on the open end spinning machine (chosen here as an example of a band processing textile machine 4) or at the can depot 5, it is a sensible matter in practice to design the sliding device 20 so long that, it is able to provide a certain buffer action.

The frame machine 2 exhibits, in accord with the illustrated embodiment in FIG. 1, a control device 21, by means of a control line 211, stands in controllable communication with a monitoring instrument 210. This monitoring instrument 210 supervises the position of the can rack 6 which is found in the work station $A_1$, and thereby oversees the progress of the filling operation.

By means of the monitoring instrument 210 which stands in communication with the control device 21, when the can rack 6 leaves the work station $A_1$ in the direction of C, a signal is released. This signal, for instance given optically or acoustically, is so that a can rack 60, manually or automatically, will be transferred from a can wagon 7 in the direction of the arrow $f_3$ into the first waiting station B, in order to be transferred, step by step, by the sliding conveyor 20 in the direction of the arrow $f_1$ to work station $A_1$.

In the case of the illustrated embodiment in which several can racks 6, 60, 61 find place beside one another on the slide conveyor 20, these are always moved in one and the same direction (arrow $f_1$). For this reason, the slide conveyor 20 is equipped with an endless belt or an endless chain (not shown).

If an endless belt or chain type slide conveyor 20 finds application, then, in the simplest and most compact manner, the slide conveyor possesses a length so that it can take at least two can racks 6, 60 or 6, 61 by one another at the same time. Within the work station $A_1$, at the division line between the two can racks, 6, 60 or 6, 61, is found the discharge area of the charging head 23. Even when the last can 3 of the forward moving can rack 6 is filled, already a further can rack 60 of a can wagon 7 is being brought in the direction of the arrow $f_3$ into the waiting station B.

The can wagon 7 is subsequently brought into a position in which, after the filling of the combined cans 3 of the previous can group 31, it is able to take the position of the can rack 6, which has been withdrawn in the transfer onto the can wagon 7 in the direction of the arrow $f_4$.

The exchange of can racks 6, 60, 61, . . . , n, is done in the depicted embodiment by means of the stopping of a can rack 60 with empty cans 3 in the waiting station B of the framing machine 2, and the pick up of another can rack 61 with filled cans 3 from the waiting station C. In this operation, the possibility is that, as one can infer from the above explanations, in a simplified design of the slide conveyor 20, the waiting station B or C is coordinated with the working station A.

If the slide conveyor 20 of the frame machine 2 is sufficiently long, then without interrupting production, it is possible, with one and the same can wagon 7, to first deliver a can rack 60 with an empty can group 310 to the waiting station B, and then subsequently another can rack 61 with a filled can group 311 is picked up from the waiting station C.

In the case of multiple frame machines 2, the description above is still valid in an analogous manner. In such a case of, for instance, two charging heads 23, there will be a separate slide conveyor 20 provided for each charging head.

Immediately, for the reason that at the frame machine 2 the cans 3 do not proceed one by one from the can wagon 7 and are individually returned, a substantial saving is achieved in regard to time, design, and material expenditures. The filling of one can 3 on the frame machine 2 requires only a relatively short time, so that a plurality of can exchanges is necessary which contributes to the effectiveness of the described simplification and improvement.

A can exchange on a fiber processing textile machine 4, on the other hand, is not so often necessary, since, especially in the production of fine yarns by means of a spinning machine, the emptying of a supply can lasts a longer time. Thus, a can exchange on the textile machine 4 carried out in the previous conventional manner is not such a serious matter as in the case of the frame machine. Nevertheless, in practice, things go along in accord with the described operational method of FIG. 1, similar to that of the frame machine 2, so that the advantages illustrated in connection with the frame machine 2 are also given consideration for a fiber band processing textile machine 4.

After the removal from the frame machine 2 of a can rack 6 with a can group 31, complete with filled cans 3, the can wagon 7 brings the can rack 6 to the fiber band 30 processing textile machine 4, or, in case no filled cans 3 are immediately required at that place, then they are taken to the intermediate can depot 5. At that place, the can rack 6, together with the can group 31 upon it, remain stopped (processing of the fiber bands 30, or intermediate storage of the can group 31) while the can wagon 7 moves on without can rack 6 for the assumption of further assignments.

As FIG. 1 shows, the can groups 31, 310, 311 and the associated can carrying can racks 6, 60, 61 are all of the same size. In this way, the can racks 6, 60, 61 find use at any optional position of factory layout 1. That would include frame machine(s) 2, fiber processing textile machine(s) 4, and can depot(s) 5.

The fiber band processing textile machine 4 possesses a multiplicity of spin positions D placed beside one another, as well as other work stations (for instance on a knitting or weaving machine) which stations are all designed the same. The textile machine 4 is divided into several sections 40 because of its great length, which always exhibit a definite number of spinning positions D—which stand here as a synonym for every work station which comes to consideration.

So that the can racks 6, 60, 61 with the cans 3 completely find a prepared place on or under these textile machines without the necessity of manipulating and maneuvering said can racks 6, 60, 61, when a can group 31, 310, 311 with empty cans 3 is to be exchanged as a complete unit for a can group 31, 310, 311 with filled cans 3, then, in accord with FIG. 1 and 5, the sections 40 and the can racks 6, 60, 61 are so dimensioned that either a single can rack 6, 60, 61 or an multiple integer thereof can find space next to each other simultaneously in an optimal manner in a second third, fourth . . . work station $A_2$, $A_3$, $A_4$ . . . (FIG. 5) under the textile machine 4. So that one and the same can rack 6, 60, 61 may be put to use at all the components of the setup 1, the can racks 6, 60, 61, and also the slide conveyor 20 of the frame machine 4, are sized to fit the section(s) 40 of the fiber band processing textile machine 4—or, vice versa, the sections 40 are made to fit on the normal sized (as pallets) can rack 6.

While as a rule, in the case of a frame machine 2 with an endless belt or an endless chain, in correspondence with the above description said machine has a certain buffer zone, a buffer zone of that type is not foreseen on the fiber band processing textile machine 4. However, there must be essentially enough play provided for the can racks 6, 60, 61 during their exchange operations, so that there will be sufficient maneuvering space available. In this matter, as will be more completely described in connection with FIG. 5, fundamentally a can rack 6 with empty cans 3 is first removed from the fiber band processing textile machine 4 before it is possible for another can rack 6 with filled cans 3 to take over the place of the first can rack 6.

In accord with FIG. 1 and FIG. 5, there are indeed always provided in conformity two can racks 66 and 67 with respectively five cans 3 per section 40. This is in no way to be interpreted as a limitation of the invention. It is also easily possible, instead of that, to place a single can rack 6, or three or more can racks 6 with a diverse number of cans 3 per can group 31. This depends on the size of the can rack and the kind of the fiber band processing textile machine 4, to which machine the cans 3 must be brought for the processing of the fiber bands 30.

As has already been stated above, the open end spinning machine, on which the above description is based and which is depicted in the illustrations, is essentially an example for a band processing textile machine 4. Other band processing machines 4, for instance circular knitting machines, exhibit no section 40 as do the ring spin or the rotor or other kinds of open end spinning machines.

Even in such a case, is it advisable that the fiber band processing or consuming textile machine 4 and the can rack 6 are designed to coordinate with one another. However, where lap round-knitting machines are concerned in which the space relationships are more favorable than in the case of spinning machines or flyers, in certain circumstances this dimension centered coordination may be dispensed with.

Also, the can depot 5 is so designed that there is always a definite number, that is, an multiple integer of can racks 66, 67 which find space beside one another. For each one can rack 6, there is a defined placement space E (storage position) reserved. This is so that the foreseen number of can racks within the can depot 5 can also find stopping places and not have their place disappear through inexact placement of can racks.

As FIG. 1 shows, there is provided in the case of the automatic transport equipment of layout 1 depicted there, a central control device 71 which is connected in accord with control specification with:

control equipment 21 by means of control line 710 of band delivering frame machine 2, a control device 41 of the band processing textile machine 4 by means of control line 711 and with the can wagon 7 by means of control line 712.

In accord with FIG. 1, a further control line 713 is foreseen which could provide control communication for an additional, not shown, band processing textile machine 4.

It is not required, that the "control lines" in the concept of the present invention are created by means of a cable; control connections without cable, i.e. by radio, infrared, etc. may find application in place of wired cable connections.

Through these control lines 710, 711, 713 etc., the control center 71, which coordinates the operations of the can wagons 7, or the can wagon 7, receives data input as to how far the work on the individual components of the layout 1 has progressed, for example, how many can racks 6 etc. are to be placed in position for removal, and said control center is enabled to provide priority for the operation of this or for the can wagon 7.

Accordingly, the control center 71 determines the transport paths and transport start time and gives its control command to the appropriate can wagon 7, which approaches the machine 2, 4, or the can depot 5. Essentially, a single, closed track 70 is foreseen for a plurality of can wagons 7, and a circulation method for these can wagons 7 is defined, for instance in accord with arrow $f_5$. From this circulation direction depends the lengths of travel, which a can wagon 7 has to run through for reaching the component which is to be served or approached by it in accord with the evaluation of the control center 71.

In accordance with the size of the layout 1, the possibility arises that a closed rail circle does not suffice, especially when a plurality of band processing textile machines 4 must be taken care of within one and the same layout 1. In this case, it is purposeful if the components to be approached or to be served are not all arranged behind one another with a closed track 70. This track 70 may exhibit switches 700, 701 etc., on which the can wagon 7 can leave the main track in order to be able to reach and serve layout components on a parallel rail section 702, such as a further textile machine 4 or a can depot 5.

In the case of a self running can wagon 7, this possesses a can rack receiver 72 for the can rack 6, 60, 61, 66, 67 which has no other task to fulfill except to carry the complete can group 31. The can racks 6, 60, 61, 66, 67 may be very simply designed, so that even a conventional commercial pallet with normal outside dimensions can take over this task (see FIG. 4 and 5).

Should a conventional commercial pallet find application as a can rack, then the components of the layout 1 and the pallet size, which would yet to be determined, should be coordinated with one another so that, as already mentioned, always a multiple integer of can racks 6, 60, 61, 66, 67 can find a place under the textile machine 4, that is to say, under its sections 40.

The can racks 6, 60, 61, 66, 67 required in greater numbers remain at any given time in the single components of layout 1. These can racks 6, 60, 61, 66, 67 are simple in construction and thus of low cost in their manufacture and upkeep. The can wagon 7, of which simply a few examples would be necessary, and which, especially in automatic equipment, are expensive to build, need not remain motionless at the individual components of the layout 1.

However, not only the costs and the time expenditures for the manufacture and maintenance on the can wagons are reduced. Further cost reductions arise in practice because the cans 3 are not individually handled when taken from can wagon 7 to the frame machine 2 or singly delivered to or taken away from any of the other components of the layout 2. The same argument holds in regard to the band processing textile machine 4, or its can depot. The cans 3 continually remain on the can racks 6, 60, 61, 66, 67 so that the time otherwise required for individual handling of the cans 3 is no longer a factor and thus time for can handling is reduced to a minimum.

In the movement zone of fiber band 30 fed from a spinning position D to a can 3, there is a monitoring device 42 (Band supervision—see FIGS. 1 and 4) which, by means of a control line 420 is in connection with the control device 41 of the band processing textile machine 4. If the fiber band 30 fed to a spinning position D band runs out or breaks, then the said monitoring device 42 announces this immediately to the control device 41.

The monitoring device 42 can be designed in different ways. Should, for instance, a can exchange (as "can exchange" a complete can group 31 etc. on a can rack 6 etc is meant) be carried out, only if all the fiber bands 30 of the collective cans 3 of this can group 31 etc. are run out or broken, then suffices a single, common monitoring device 42 for the entire can group 31 etc. In this case, the monitoring device 42 first emits a signal to the control device 41 if none of the spinning positions D assigned to this can group 31 are able to continue operation. In this situation, the control device 41 then demands from the control center 71 an exchange of the can rack 6 . . . with the empty cans 3 for another can rack 6 . . . with filled cans 3.

An alternative is available in which each spinning position D is assigned a separate monitoring device 42, so that each individual fiber band 30 of this can group 31 . . . is supervised and its running out or breakage is recorded and announced to the control device 41. If desired, the control device 41 may be provided with an adjustment arrangement 410. This adjustment arrangement 410 allows a value to be specified for the number of non-working cans 3 of the can group 31 . . . which is found on can rack 6 . . . , in which said cans the fiber band 30 has run out or is broken. Thus, upon reaching a value of a specified number of the said recordings, a corrective function is triggered. Optimally, such a function may be triggered by the running out or breakage of a single fiber band 30 (however, also by two fiber bands 30 up to the entire number of fiber bands 30 of this can group 31 . . . which are run out or broken.). A demand signal may be input to the control center 71, whereby an exchange of the can rack 6 . . . for another may be called for by way of wagon 7 with filled cans 3. If no automatic can transport facility is provided, which means there is no attendant control center 71, then the monitoring device 42 (by interlock with the control device 41) produces an acoustic, optical or combined signal, which advises an operator 9 of the failure of said fiber band 30 or these fiber bands 30, so that this operator can carry out the exchange by hand.

Even if the exchange of a can group 31 . . . for another can group 31 . . . with filled cans 3 has been carried out, although all cans 3 of the previous can group 31 . . . have not been worked down to empty, this early exchange of the can group 31 . . . is nevertheless to be recommended, since the fiber band residuals in the remaining cans 3 of the previous can group 31 . . . in the work place $A_2$ are generally of little consequence. Thus a waiting period, so that the other cans 3 of this can group 31 . . . will be emptied, causes a longer down time of the already inactive spinning position D. This is much more expensive than the said early exchange and so increases operating costs.

In the case of a minimal degree of automation, the layout 1, as an option, may dispense with the monitoring apparatus 210 on the frame machine 2 and/or the monitoring device 42 on the band processing textile machine 4. In this case, the operator 9, himself, must remain aware of exchanging a can rack 6 . . . at the right time.

The foregoing description shows that even the procedure, as well as the apparatus, may be changed and rearranged in a multitude of ways. It is possible within the framework of the present invention to replace individual features with their equivalents, or apply the features in different combinations.

For instance, it is not necessary that the can wagon 7 be designed as a self driven vehicle. It is thoroughly advantageous and purposeful, especially in the case of small layouts, or in layouts in which generally a lower automation degree is provided, to operate the transport of the can racks 6, 60, 61, 66, 67 between the individual components of the factory layout by hand with the help of simpler can wagons 73, 79, which said wagons are provided for this purpose with a handgrip yoke (see FIG. 2, 3 and 5).

The can wagon 79 may be built differently and, for instance, exhibit a similar can rack receptor 72 as does the can wagon 7, described with the help of FIG. 1.

Also, in the case of manually operated can wagons 73, 79, a path (track 70) is to be kept clear, along which the said wagon can move between the individual components of the factory layout 1.

In accord with the embodiment shown in FIG. 4, a fork lift truck is shown substituting for a can wagon, which picks up the can rack 65, which in turn is designed as a pallet. The lift is effected by "pumping", so that the can rack 65 is lifted from the floor 10 and brought to the desired place within the plant layout 1.

In FIG. 4 also shows the band processing textile machine 4 (here an open end spinning machine) and two can racks 63 and 64 with can groups 312 and 313. The textile machine 4 possesses underneath the spinning position D with the (not shown) spinning accessories, an unobstructed height h of such a nature that a can rack 63 . . . can find placement here and also the fiber bands 30 may be fed without hindrance to the spinning machine. Moreover, there must be sufficient space that the maintenance automat 43 may run unobstructedly alongside the textile machine 4.

An opening not seen in FIG. 4 (second work station $A_2$, see FIG. 5) located below the textile machine 4 came about in that a can rack (not shown) with a can group having emptied cans has been picked up with a fork lift truck 78. An operator 9 has just brought on a new can rack 65 with a can group 314 with filled cans 3 and is just about to complement this second work station $A_2$ with the new can group 314. The operator 9, therefore guides the can rack 65 with the aid of the fork lift truck 78 into this work station $A_2$. When insertion is complete, the operator lets the can rack 65 down, so that the fork lift truck, without taking with it the can rack 65, along with the can group 314 that goes with it, may withdraw from the textile machine 4.

In accord with a further simple design, (FIG. 5), the can wagon 79 possesses simply a platform (not shown) on which the can rack 6 is set, which said can rack 6 has, in all practicality, been designed as a pallet.

Figure 2:
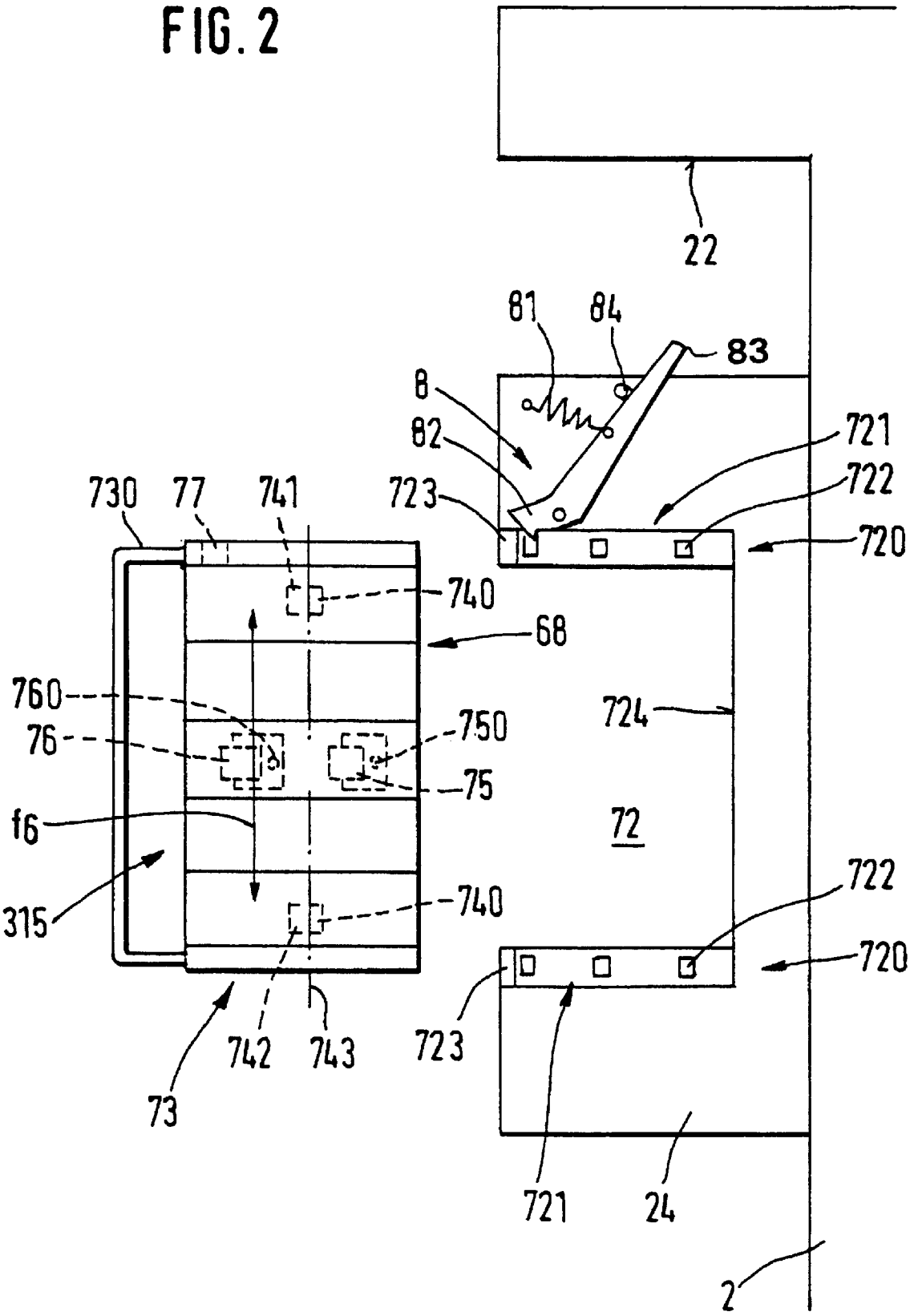
FIG. 2 is a plan view of a portion of a frame machine with a slide conveyor as well as a readily available can rack for transfer to the slide conveyor.
Figure 3:
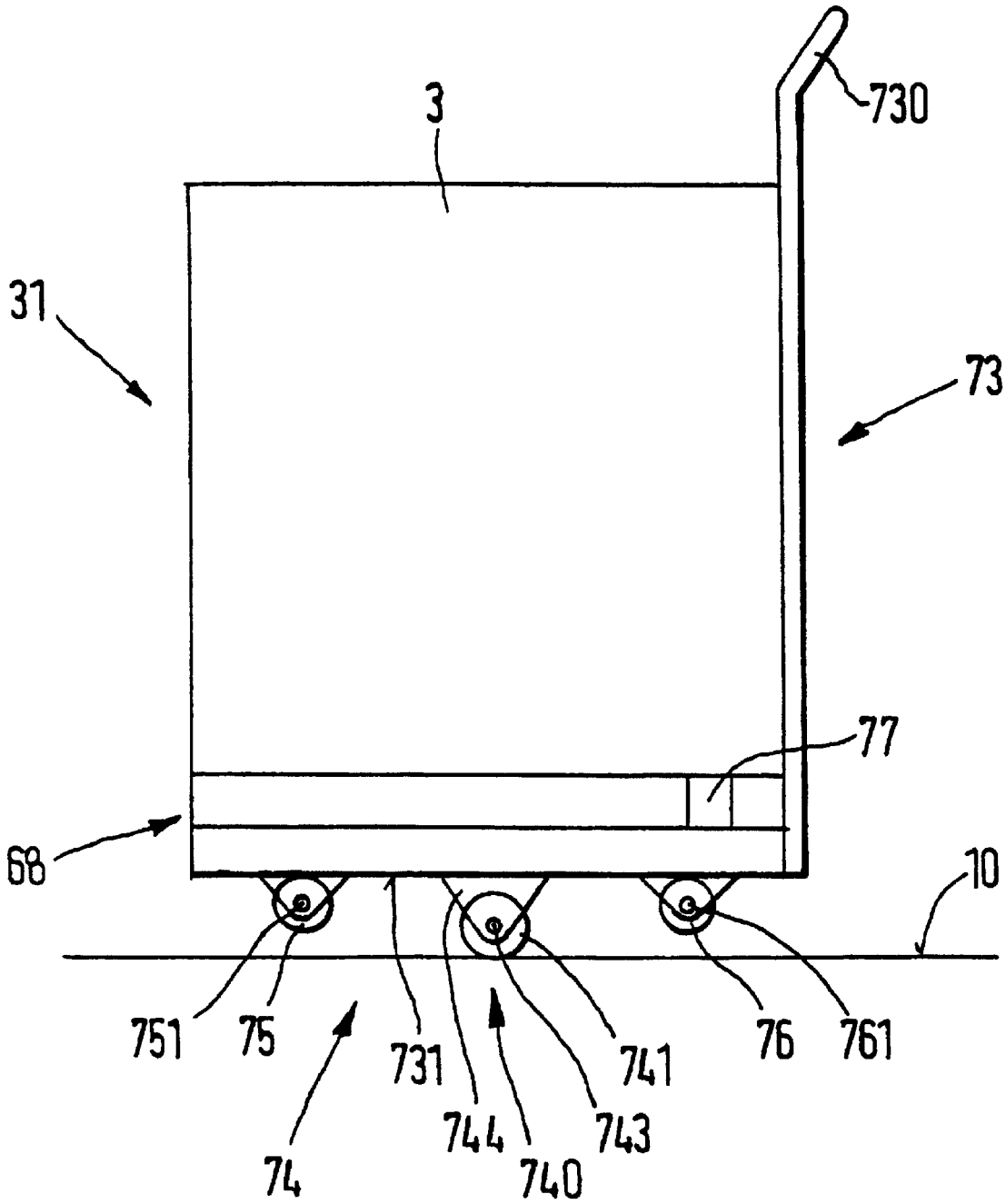
FIG. 3 is a can wagon in accord with FIG. 2 in profile view.

Principally, the possibility exists, of transporting the can rack 6 by either the help of a separate transport medium, that is, a can wagon 7, 79 or a fork lift truck 78, by hand or automatically between the individual components of the setup 1, or again to design the can rack 68 as an integral part of the can wagon 73 (FIG. 2 and 3). The said wagon would, with the help of its handgrip yoke 730 be transported as a unit between the individual components of the setup 1, and also as a unit always with one and the same can group 315 being placed at the said individual components of the factory setup 1 for work or storage purposes.

The can wagon 73 (see FIG. 2 and 3) or 79 (FIG. 5) possesses—independent as to whether the can rack 6 . . . is an integral part thereof or not—an under carriage with at least one pair of wheels 740.

In this case, the common axle 743 of said wheel pair 740, or the two axles of the wheels 741, 742 of this wheel pair 740 is (or are) oriented parallel to the longitudinal extension (double arrow $f_6$) of the can group 31. This common axle 743 does not require—that is to say, the two axles (not shown) of the wheel pair 740 do not require—to be of the swivelling type, since even without this swivelability the wheels 741 and 742 of the can wagon 73, 79 permit themselves to be easily maneuvered. The bearing(s) 744 for the axle(s) 743 is—that is to say are—on this account rigid with the can wagon 79, that is, affixed to them as an integrated part of the can rack 68 designed for the can wagon 73. Without difficulties, it is possible to (at least partially) run the can rack 6 . . . or the can wagon 73 with an integrated can rack 68 into a receiver recess 72 . . . fittingly dimensioned for the can rack 6. This would be on the frame machine 2 of the band processing textile machine 4, or a can depot 5, in order to transfer the can rack 6 . . . , i.e. the can wagon 73, through sliding onto the said can rack recess, and thereby transfer said rack to the framing machine 2, to the band processing textile machine 4, or the can depot 5.

The can rack receiving recess 72 exhibits, in accord with FIG. 2, two can rack guides 720, into which the can rack 6 . . . , or the can wagon 73 comes to a stop.

For this purpose, the can rack 6 . . . or the can wagon 73, conforming to the shape of a group 31 . . . of cans orderly arranged thereon, possesses skids 62 on the underside (see FIG. 4) upon which said can wagon 73 stands in all, or various components of the setup 1 (including in the forklift 78, or in the can wagon 7 or 79). The can rack guide 720, for itself, exhibits a rolling surface 721 with rollers 722 in order to ease the sliding of the can rack 6 . . . or the can wagon 73. Such a rolling surface 721 is provided on the individual components of the factory setup 1, if desired, and on the can wagon 7 . . . , independently of can rack 6 . . . .

Especially, a can wagon 73, serving as a can rack which is to maneuver within the can rack receiver recess 72, must be exactly positioned in order to be able to carry out this movement into the can rack receiver recess 72 without great difficulty. For this purpose, it principally suffices if simply a single wheel pair 740 is provided, since in this way the can wagon may be very easily handled or swivelled about. If indeed only this pair of wheels 740 is provided, then the can wagon 73 is unsteady.

In order to fundamentally avoid the possibility of tipping over, in accord with the FIGS. 2 and 3, the can wagon 73, besides the pair of wheels 740—speaking of the wheel pair 740, that is, the thereby fixed line of motion of the can wagon 73—possesses at least one leading wheel 75 alone, or a trailing wheel 76 alone, or even yet a leading wheel and also a trailing wheel 75, 76 respectively. This wheel 75 or 76 or, in case so provided, these two wheels 75 and 76, has/have always a vertically carried pivotable axle 750 or 760, so that the can wagon 73 on the one hand, by means of this leading or trailing wheel 75 or 76, that is to say, by means of these two wheels, is stabilized and enables the steering of the can wagon without difficulty.

A further improvement of the steerability of the can wagon 73 is achieved by the design of the undercarriage 74 (wheel pair 740 and wheels 75 and 76) in accord with FIG. 3. With this design, the axle(s) 743 (not shown) of the wheel pair 740 possess(es) a greater distance interval from the floor 731 of the can wagon 73 than do the horizontal axles 751 and 761 of the wheels 75 and 76. Thereby the can wagon 73 is allowed to be tilted up to a certain degree about the axle(s) 743 of the wheels 741 and 742 of the wheel pair 740, wherein the can wagon 73 takes on a stable end position when it supports itself either on its wheel pair 740 or on the wheel 75 or 76. On the other hand, in its unstable intermediate position, it comes into contact with the floor 10 with neither of these two wheels 75 and 76 and is supported solely on the wheel pair 740. The fewer wheels come into contact with the floor 10 in maneuvering, just so much easier is the can wagon 73 to steer. Otherwise, the can wagon 73 upon support solely by means of the non-swivelable wheel pair 740 is unstable, on which account, for the transport of the can wagon 73 from one component of the factory setup 1 to another, always one of the two other swivelable, i.e. steerable wheels, 75 or 76 are chosen for the support of the can wagon 73.

The possibility of being able to tilt the can wagon 73 about the axle 743 (or the two axles) of the wheel pair 740 leads, nevertheless, to an additional advantage upon the running of the can wagon 73 (this applies to both the integrated as well as the separate designs of the can racks) into the can rack receiving recess 72. By means of tilting about the said axle(s) 743, it is possible to raise the leading end of the can wagon 73. By this means, the can rack 6 . . . , or the can wagon 73, comes into the can rack guide 720, the entry area of which can be designed as ramp 723 in order to lift the can rack 6 . . . or the can wagon 73 further from the floor 10. The mentioned roll surface 721 can extend itself into the ramp 723.

Insofar that no roll surface 721 is foreseen, the can rack 6 . . . or the can wagon 73 is sufficiently secured by friction. in its position, i.e in the individual components of the factory setup 1 (in the case of a non-integrated design) on the can wagon 79 or 7. If a roll surface 721 is provided, then, as a rule, it is likewise not to be expected that the can rack 76 . . . , or the can wagon 73 will leave its position within the can rack receiving recess 72. Nevertheless, further means are advisable for the locking in position of the can rack 6 . . . in its work position $A_1$ . . . , on the frame machine 2, on the band processing textile machine 4 or at the holding place E in the can depot 5, or even opposite the transport medium such as can wagon 7, 79 or fork lift 78. For instance, the roller surface 721 can exhibit an incline (not shown) of such a nature that the can rack (can rack 73, integrated or separate) possesses a movement component which moves it farther into the can rack receiving recess, so that it, on that end of the equipment remote from the service side, hits a detent 724. In this case, however, for the withdrawal of the can rack from the can rack reception recess 72, a greater force expenditure is necessary. In order to avoid this, in accord with the embodiment shown in FIGS. 2, 3, it has been provided, that the can rack 68 is provided with a recess at an appropriate place which, in accord with FIGS. 2 and 3, is on its side. Into this recess, a locking mechanism 8 is able to penetrate.

The locking mechanism 8 may be variously designed, and made automatic or activated by the operator 9.

As has already been shown above, the slide conveyor of the frame machine 2 can be designed in different ways. In the case of the embodiment shown in FIG. 2, the slide conveyor 24 is not, as shown in FIG. 1, laid out as an endless belt or an endless chain, but is seen as a sled or a wagon, which is so dimensioned, that is can continually accept a single can rack 6 . . . , and, with this, in the course of its function, proceed step wise from a start position to an end position and then be brought back to its start position.

In the embodiment shown in FIG. 2, the securement device 8 is installed in the slide conveyor 24. This securement device 8 exhibits a double arm, pivotally affixed locking lever 80 which, by means of a tension spring 81 is restrained in conveyor 24 by a detent 84 also in said slide conveyor 24 and lever 80 is so stressed that it, with its locking catch equipped end 82 in the track along the can rack guide 720, protrudes into recess 77 of the can rack 6 . . . or can wagon 73 which is to enter the can rack receiver recess 72. The free end 83 of the locking lever 80 extends over the outer contour of the slide conveyor 24 of the frame machine 2. This end possesses a stationary detent 22, which, upon the running of the free end 83 of the locking lever 80 against the action of the spring 81, the locking catch 82 pivots of the movement path of the can rack 6 . . . or the can wagon 73 thereby releasing which ever rack or wagon is in service.

If the can rack 6 . . . or the can wagon 73 with the integrated can rack 68 moves into the can rack receiver recess 72, then the locking lever 80 must be forced out of the movement path until the can rack 6 . . . or the can wagon 73 reaches the correct end position, then the lock catch 82 can grip into the recess 77 of said rack and thus assures the holding of the can rack 6 . . . in its position. In this now assured position, the can rack 6 . . . or the can wagon 73 remains, while the frame machine 2 fills the cans 3 of the can rack 6 . . . or integral rack 68, whereby the slide conveyor 24 runs the can rack, step by step by the filling station 23 of the frame machine 2. When all cans 3 of the can group 31 on the can rack are filled, then the slide conveyor 24 moves the free end 83 of the locking lever 80 up against the stationary detent 22, whereby the locking lever 80 is so pivoted, that the catch 82 is withdrawn from rack recess 77, the said rack 6 . . . is released and can be taken out of the slide conveyor 24. When the can rack 6 . . . has left the slide conveyor, then the lever is again moved back into its original setting.

An entry of a new can group 31 . . . with the help of another can rack 6 . . . may be done taking an optional position on the motion track of the slide conveyor 24, that is, it can be as well in one or another end position, and as well in an intermediate position.

As the immediate described embodiment shows, it is not required, that the band delivering machine (frame machine 2), as this is shown in FIG. 1, besides a first work station $A_1$ possesses also still a first and possibly a second waiting station B and/or C.

Previously, various designs were discussed relative to a securement device, for instance a detent 724 on the closed end of a can rack receiving recess 72, a locking device 8 as well as the friction of the can rack guide 720. If by a can rack equipped with a wheel under carriage (can wagon 73) no locking device 8 is provided, then the under carriage must in some way be made inactive. This is done in accord with the above described explanation, in that the can rack 73, by tipping about the wheel pair 740 on the can rack guide 720 is lifted and is pushed onto the conveyor 24, whereby the undercarriage 74 is also lifted from the floor. In kinematic turn around, it is also within the bounds of thought to provide under the components of the factory setup 1, lowerable plates or the like for the securing of the the can rack 6 . . . in its working position. To remove the said can rack 6 . . . from that position, the said plate may be raised. In both described explanations, the locking apparatus as well as a lifting device, which in the first case acts directly or indirectly (by the can wagon 73) on the can rack 6 . . . , in order to lift this from the floor 10, while in the other case simply the base support for the under carriage 74 is withdrawn.

It will be apparent to those skilled in the art that various modifications and variations can be made in the present invention without departing from the scope and spirit of the invention. It is intended that the present invention include such modifications and variations as come within the scope of the appended claims and their equivalents.

What is claimed is:

1. A system for transporting textile cans between different textile machines for filling the textile cans with a fiber band, said system comprising:

a fiber band delivery machine;

a fiber band processing machine;

a can depot;

a plurality of can racks, each said can rack configured to carry a group of individual cans thereon;

a can wagon movable between said fiber band delivery machine, said fiber band processing machine, and said can depot, to transport said can racks therebetween;

a slide conveyor configured at said fiber delivery machine, said slide conveyor having a length so as to accept at least one said can rack from said can wagon, said slide conveyor moving said can rack in a direction past a charging head of said fiber band delivery machine such that said cans are sequentially moved from said can rack to said charging head and back to said can rack; and a fiber band delivery control device configured to control transfer of said can racks to and from said can wagon at said fiber band delivery machine; and wherein upon filling of a last can of a first said can rack at a filling station of said fiber delivery machine, said control device generates a control signal causing said first can rack to be moved by said slide conveyor out of said filling station and another said can rack to be transferred to said slide conveyor, said first can rack being conveyed by said can wagon to one of said can depot and said fiber band processing machine.

2. The system as in claim 1, wherein said slide conveyor has a length so as to accommodate a plurality of said can racks.

3. The system as in claim 2, wherein said can wagon is automated and movable on a track between said fiber band delivery machine, said can depot, and said fiber band processing machine.

4. The system as in claim 1, wherein said slide conveyor comprises an endless chain or belt.

5. The system as in claim 1, further comprising a central control device in communication with said fiber band delivery control device, said can wagon, and a control device of said fiber band processing machine, said central control device controlling and coordinating transportation of said can racks by said can wagon.

6. The system as in claim 1, further comprising a securement device configured with said slide conveyor for holding said can rack relative to said slide conveyor.

7. The system as in claim 6, wherein said securement device further comprises a lifting mechanism.

8. The system as in claim 1, wherein said can rack is integral with said can wagon.

* * * * *